US010107608B2

(12) United States Patent
Tedde

(10) Patent No.: US 10,107,608 B2
(45) Date of Patent: Oct. 23, 2018

(54) CARTRIDGE FOR LIGHT WEAPONS

(71) Applicant: Salvatore Tedde, Ardara (IT)

(72) Inventor: Salvatore Tedde, Ardara (IT)

( * ) Notice: Subject to any disclaimer, the term of this patent is extended or adjusted under 35 U.S.C. 154(b) by 0 days.

(21) Appl. No.: 15/549,601

(22) PCT Filed: Feb. 9, 2016

(86) PCT No.: PCT/EP2016/052705

§ 371 (c)(1),
(2) Date: Aug. 8, 2017

(87) PCT Pub. No.: WO2016/128387

PCT Pub. Date: Aug. 18, 2016

(65) Prior Publication Data

US 2018/0031358 A1 Feb. 1, 2018

(30) Foreign Application Priority Data

Feb. 10, 2015 (IT) ..... RM2015A0058

(51) Int. Cl.
*F42C 19/08* (2006.01)
*F42B 5/02* (2006.01)
*F42B 5/26* (2006.01)

(52) U.S. Cl.
CPC ..... *F42C 19/0807* (2013.01); *F42B 5/02* (2013.01); *F42B 5/26* (2013.01); *F42C 19/08* (2013.01); *F42C 19/083* (2013.01); *F42C 19/0823* (2013.01)

(58) Field of Classification Search
CPC .... F42B 5/02; F42B 5/26; F42C 19/08; F42C 19/083; F42C 19/0807; F42C 19/0823
USPC ..... 102/464–470
See application file for complete search history.

(56) References Cited

U.S. PATENT DOCUMENTS 2,286,775 A * 6/1942 Weldin ..... F42B 5/16 102/470
2,294,822 A * 9/1942 Albree ..... F42B 5/285 102/464
3,602,143 A * 8/1971 Critcher ..... F42B 7/04 102/449
3,776,136 A * 12/1973 Dix ..... F42B 5/02 102/430
3,911,821 A * 10/1975 Finot ..... F42B 5/36 102/470
5,033,386 A * 7/1991 Vatsvog ..... F42B 5/307 102/430
6,862,993 B1 * 3/2005 Cudazzo ..... F42B 5/28 102/430
2010/0282111 A1 * 11/2010 O'Dwyer ..... F42B 5/035 102/438
2014/0060373 A1 * 3/2014 Maljkovic ..... F42B 33/10 102/467

(Continued)

FOREIGN PATENT DOCUMENTS

CA 2570743 A1 * 6/2008

*Primary Examiner* — James S Bergin
(74) *Attorney, Agent, or Firm* — Abelman, Frayne & Schwab

(57) ABSTRACT

A fractionated-combustion cartridge is made by inserting a bushing into the cartridge case at the height of the bottom, the bushing being coaxial with said cartridge case, and the face of which, facing the interior of the cartridge case, is provided with a trigger guard coinciding with the diameter of said face.

11 Claims, 4 Drawing Sheets

(56) References Cited

U.S. PATENT DOCUMENTS

| | | | | |
|---|---|---|---|---|
| 2014/0261042 | A1* | 9/2014 | Imhoff | F42B 5/03<br>102/438 |
| 2016/0018199 | A1* | 1/2016 | Nemec | F42B 5/02<br>102/439 |

* cited by examiner

CARTRIDGE FOR LIGHT WEAPONS

CROSS-REFERENCE TO RELATED APPLICATION

This application claims benefit under 35 U.S.C. § 371 to international application No. PCT/EP2016/052705, filed on Feb. 9, 2016, which claims priority to Italian application no. RM2015A000058, filed Feb. 10, 2015, the contents of which are incorporated by reference in their entireties.

FIELD OF THE INVENTION

This invention relates to the field of munitions for light firearms such as rifles and rifled barrel machine-guns.

BACKGROUND ART

In modern firearms, the cartridge comprises both the gunpowder and the primer and bullet in a single firing module.

The cartridge consists of a cylindrical housing, referred to as the cartridge case, generally made of brass, containing the gunpowder. Said cartridge case is closed at the two ends by the bottom and by the actual bullet itself. The primer for the powder is contained within a capsule, referred to as the percussion cap, located in the bottom.

The impact of the percussion cap causes the priming mixture to detonate giving rise to an intense burst of flame and then to the deflagration of the gunpowder. The combustion of the powder then propagates to the entire mass of the latter in a very short time. While burning, the powder generates a large amount of high temperature gas, the pressure of which, as the gases are confined within a small volume, rises rapidly to very high values. The gas expansion, contained by the walls of the cartridge case, contained in turn by the walls of the combustion chamber, and by the bottom which thus remains pressed against the bolt, may occur only in the axial direction against the bottom of the bullet. The bullet is thus accelerated, pushed by the gases, the pressure of which will continue to increase until the bullet has left the cartridge case thus beginning its travel within the firearm barrel. More precisely, the gas pressure increases until the increase in gas volume will exceed the available space, i.e., until a balance has been achieved between the increase of volume and the available space, which balance is generally achieved once the bullet has traveled a few cm. At this point, the pressure will have reached its peak value and will then begin to decrease as the available space between the bottom and the base of the bullet increases. The pressure drop is also due to the fact that a part of the gas energy is converted into kinetic energy of the bullet and a part is also used to overcome the friction along the barrel which is very high for rifled barrels. Therefore, the bullet is pushed at ever-increasing speeds until it leaves the firearm barrel.

Gunpowders may roughly be divided into slow burning or fast burning in relation to the combustion process. Since the so-called fast-burning powders deflagrate faster, they produce a generally narrower and higher peak pressure than the so-called slow-burning powders. The 12.7×99 mm caliber NATO cartridge, otherwise known as .50 BMG, for example, uses powders having a particularly "slow" combustion rate, a pressure peak of about 4000 BARS and a muzzle velocity of about 900 m/s for a barrel of about one meter. As the bullet exits, the gas pressure will have reached a value of about one-fifth of its peak value. It is worth controlling the combustion so that it remains confined within the barrel, i.e., the powder must burn completely before the bullet has left the barrel, both to exploit all the potentially available energy, and to prevent the residuals from igniting beyond the muzzle of the firearm. Moreover, the peak and muzzle pressures are required to not exceed certain values and their ratio needs to remain within the limits mentioned above.

Assuming the use of a propellant burning more quickly than that described, i.e., a propellant characterized by a higher combustion rate, in the first firing situation, an excessive rise of peak pressure could occur, being large enough to abundantly exceed the strength limitations of the mechanical barrel/bolt assembly. Therefore, in extreme cases, a bursting effect could occur instead of a propulsive effect. Furthermore, an excessive peak value could lead to a premature wear of the barrel rifling. It is thus important to find new ignition devices which regulate the pressure values so that the combustion can take place in an increasingly safe and efficient manner even if high-combustion-rate propellants are used.

SUMMARY OF THE INVENTION

An object of the present invention is to manufacture a cartridge provided with a simple device which allows the propulsion process occurring during the combustion of the gunpowder to be improved, in order to optimize the ballistic performance of the accelerated bullet.

The idea is to modify the priming device thus enabling the ignition phenomenon to be fractionated over time so as to limit the peak pressure value.

The object is achieved by means of a cartridge, according to claim 1, consisting of a cylindrical housing defining a longitudinal axis and containing gunpowder, said cylindrical housing being closed at one end by a bottom and at the other end by a bullet, said bottom comprising a priming capsule, said cartridge comprising a bushing the lower face of which is at said bottom and the upper face of which is crossed by a trigger guard at a diameter of said upper face, said longitudinal axis passing through the centers of said trigger guard, priming capsule and bottom.

Said bushing and said trigger guard advantageously form a single piece, preferably made of brass or plastic. Advantageously, said cartridge case is also made of brass. The bottom is advantageously provided with a central hole above the priming capsule, said hole being coaxial with said longitudinal axis.

BRIEF DESCRIPTION OF THE DRAWINGS

Further features and advantages of the invention will become more apparent in light of the detailed description of a preferred, but not exclusive, embodiment of a cartridge according the invention, shown by way of non-limiting example, with the aid of the accompanying drawings, in which.

The same reference numerals and letters in the figures indicate the same elements or components.

DESCRIPTION OF A PREFERRED EMBODIMENT OF THE INVENTION

Figure 1:
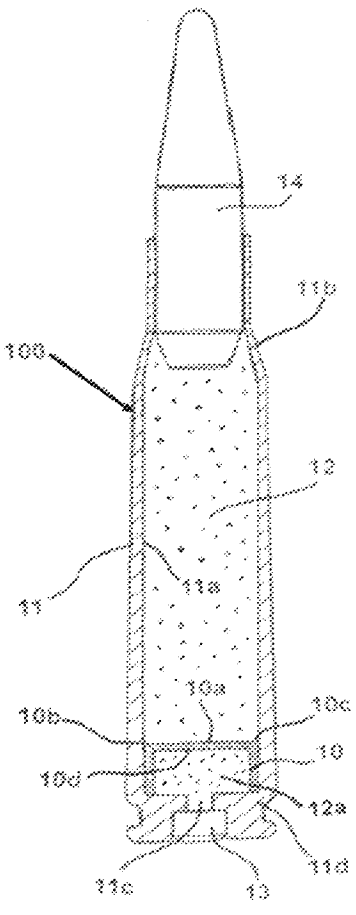
FIG. 1 depicts a 12.7×99 mm caliber NATO cartridge, the .50 BMG, modified in accordance with the invention, seen in a longitudinal section view.

A cartridge according to the invention seen in a vertical sectional view is described in FIG. 1. By way of absolutely non-limiting example, this is a 12.7×99 mm caliber NATO cartridge, otherwise known as the .50 BMG. The cartridge, indicated by numeral 100, consists of the cartridge case 11, or cylindrical housing, limited by the cylindrical walls 11*a* and closed at the upper and lower ends by bullet 14 and bottom 11*d*, respectively. The priming capsule 13 is located inside the bottom in a central position. Bottom 11*d* is provided with a central hole 11*c*, referred to as the flash hole, which puts capsule 13 in communication with powder 12 located within the cartridge case 11. The flash caused by the detonation of capsule 13 passes indeed through this hole.

Forced into the cartridge case and in contact with the bottom is bushing 10, the subject matter of the invention. The external diameter of bushing 10 is equal to the internal diameter of the cartridge case 11. Said diameter for the cartridge in question is about 17 mm, while the thickness of the cylinder which forms bushing 10 is 1 mm, and the height of the bushing is about 10 mm, corresponding to about one-tenth of the length of the cartridge case 11. Such values are merely indications and valid for the cartridge case used as an example, therefore said values may vary as the cartridge case dimensions vary. Bushing 10 is partially closed through the upper face, i.e. through the face spaced apart from bottom 11*d*, by a trigger guard 10*a*, or bridge, located along a diameter of the bushing.

Figure 2:
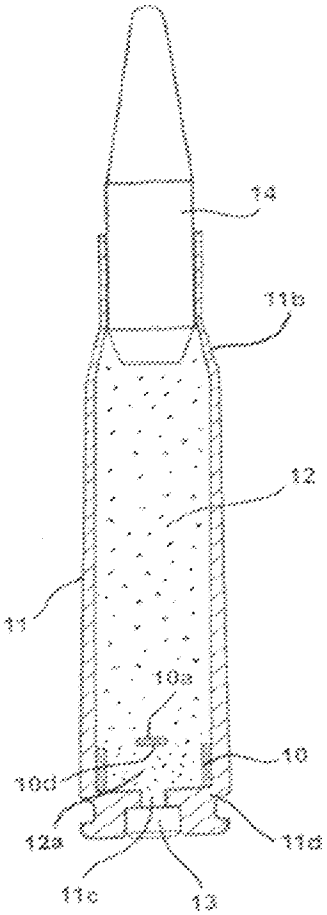
FIG. 2 depicts the same cartridge in FIG. 1, rotated by 90° about its longitudinal axis.
Figure 3:
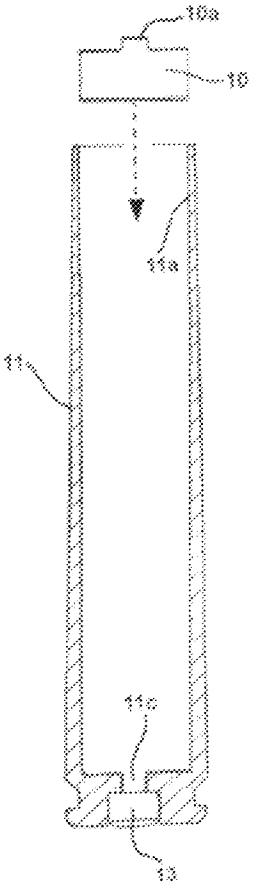
FIG. 3 depicts the cartridge case of the same cartridge in FIGS. 1 and 2 not yet assembled.
Figure 4:
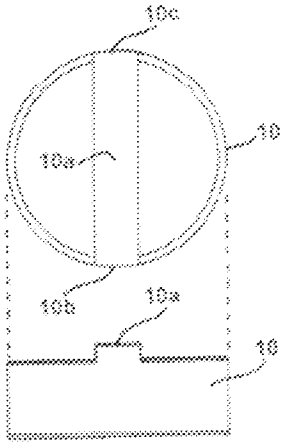
FIG. 4 depicts the bushing according to the invention seen in a top side view.
Figure 5:
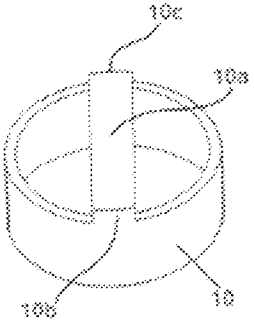
FIG. 5 depicts the bushing according to the invention seen in a perspective view.

Therefore, the trigger guard 10*a* is in a transverse position with respect to the underlying flash hole 11*c*, thus acting as a deflector of the flash caused by the detonation of capsule 13, as we will explain below in greater detail. The trigger guard 10*a* is completely immersed in the gunpowder 12. Bushing 10 together with trigger guard 10*a* form a single piece preferably made of brass. FIG. 2 corresponds to FIG. 1 rotated about the longitudinal axis of the cartridge case, by 90°, so as to show the transversal dimensions of the trigger guard 10*a*, which roughly correspond to the diameter of the flash hole 11*c*. FIG. 3 depicts the step of introducing and positioning bushing 10 within the cartridge case 11. FIGS. 4 and 5 depict the top perspective view of bushing 10 according to the invention.

The purpose of the trigger guard 10*a* is to block the jet of flame coming out of the flash hole 11*c* when detonating capsule 13. Said jet of flame, instead of propagating in the longitudinal direction along the entire mass of propellant 12, is deflected and forced to propagate radially thus causing only the combustion of the propellant 12*a* found within bushing 10. The ignition then propagates to the entire mass of the propellant. This delay in the ignition of the entire propellant causes the gas pressure to rise very rapidly when the bullet has already started to acquire velocity so that the expansion of the gases, finding available space, does not result in an excessive elevation of the maximum pressure, rather an elevation of the average pressure. In other words, the purpose of the trigger guard 10*a* is to partially inhibit the incendiary action produced by the jet of flame and to prevent it, in the first firing situation, from propagating too rapidly throughout the mass of the propellant 12 located along the cartridge case 11, before the bullet has started its travel. Through the use of bushing 10 and deflector trigger guard 10*a*, the ignition activity is advantageously fractionated over time, thus causing a lower peak pressure value and a more progressive combustion leading to a gradual acceleration of the bullet which may reach higher muzzle velocities. It was advantageously noted that by using the deflector trigger guard 10*a*, the maximum pressure reached during firing is particularly low, whereas the average pressure is higher, and the velocity of bullet 14 is increased.

Preferably, the bushing 10 is shaped as a hollow cylindrical piece, and the trigger guard 10*a* comprises a tab connected to the upper circular edge of the bushing 10, preferably by means of two connection portions 10*b*, 10*c*. Preferably, the tab has a length along a direction parallel to the diameter of the bushing 10, substantially equal to the diameter of the upper edge of the bushing 10.

The present invention has been described by way of particular example referring to particular munitions, i.e., to the 12.7×99 mm caliber NATO, otherwise known as the .50 BMG. It is apparent that the invention may be applied to other types of munitions, and the bushing may be modified with respect to the present description without for this reason invalidating the principle of the invention which is that of providing a passive mechanical device in order to fractionate the ignition of the entire mass of propellant thus making the pressure distribution along the firearm barrel more uniform.

Figure 6:
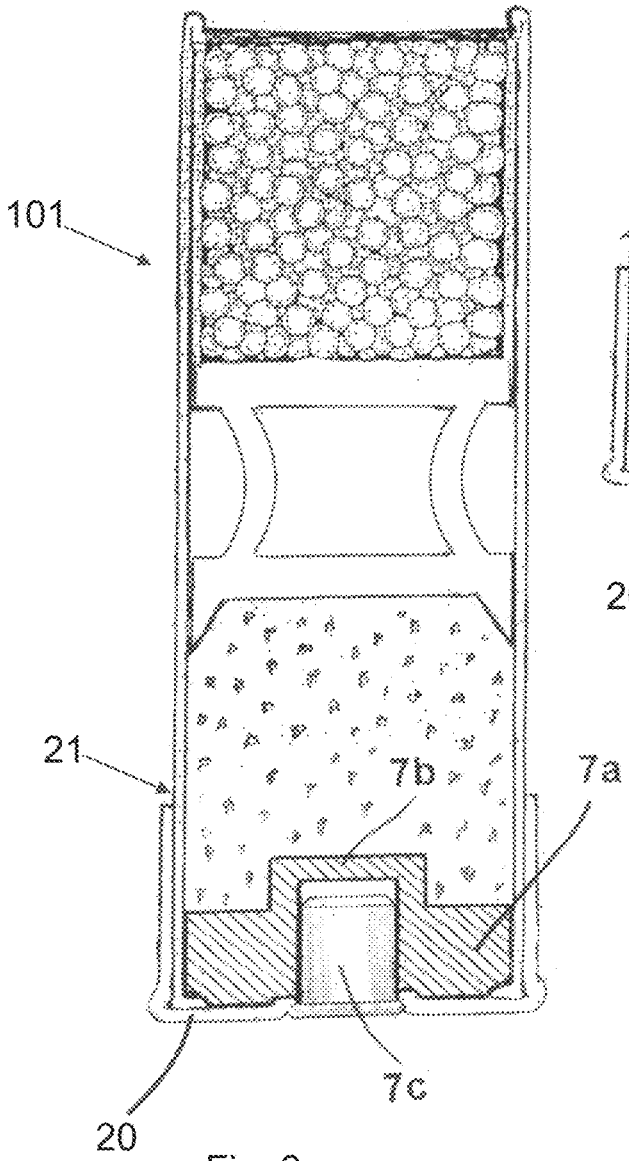
FIG. 6 depicts a cartridge according to a variant of the invention.
Figure 7:
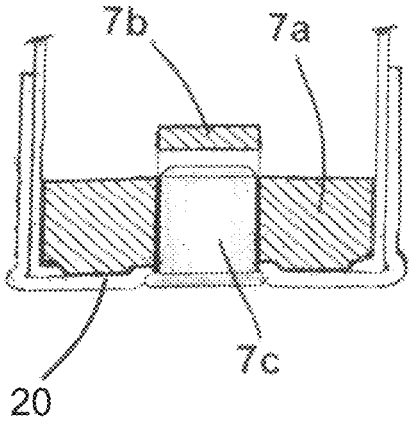
FIG. 7 depicts a particular of the cartridge of FIG. 6, rotated by 90° about its longitudinal axis.

For example, with reference to FIG. 6 and FIG. 7, the invention also provides a 12-gauge cartridge 101 for shotgun shell provided with a bushing 7*a*, or base wad, having its lower face at the bottom 20 of the cylindrical housing 21 of the cartridge. The upper face of the bushing 7*a* is crossed by a trigger guard 7*b*.

Preferably, the bushing and the trigger guard are a single piece which, preferably, is made of plastic. Preferably, the bushing 7*a* is shaped as a hollow cylindrical piece, and the trigger guard 7*b* comprises a tab connected to one circular edge of the bushing 7*a*, preferably by means of two connection portions. Preferably, the tab has a length along a direction parallel to the diameter of the bushing 7*a*, substantially equal to diameter of said edge of the bushing 7*a*. In this variant, the priming capsule 7*c* is inserted in the cavity of the bushing 7*a*.

While the foregoing is directed to embodiments of the present invention, other and further embodiments of the invention can be devised by those of ordinary skill in the art based on this description without departing from the basic scope thereof, and the scope thereof is determined by the claims that follow.

What is claimed is:

1. A cartridge comprising: a cylindrical housing defining a longitudinal axis and containing gunpowder, said cylindrical housing being closed at one end by a bottom and at another end by a bullet, said bottom comprising a priming capsule, said cartridge comprising an annular bushing having a sidewall defining an outer diameter and terminating at a lower end and an upper end, the lower end being positioned at said bottom of the cylindrical housing; and a deflector member having a width less than an inner diameter of the annular bushing, and affixed to and supported by a portion of the upper end of the annular bushing at a predetermined height over said bottom, said longitudinal axis passing through centers of said deflector member, priming capsule and bottom.

2. The cartridge according to claim 1, wherein said bottom is provided with a central hole on top of said priming capsule, said central hole being coaxial with said longitudinal axis, said deflector member being positioned over said central hole.

3. The cartridge according to claim 2, wherein the outer diameter of said bushing is substantially equal to an inner diameter of said cylindrical housing.

4. The cartridge according to claim 1, wherein a height of the sidewall of said bushing is one-tenth of a length of the cylindrical housing along the longitudinal axis.

5. The cartridge according to claim 1, wherein said bushing and said deflector member are formed as a single molded piece.

6. The cartridge according to claim 5, wherein said single molded piece is made of brass.

7. The cartridge according to claim 1, wherein the deflector member is elongated in shape and affixed at its opposing ends to the upper end of the annular bushing.

8. The cartridge according to claim 7, wherein the elongated deflector member has a width equal to the diameter of the central hole formed in the bottom of the cartridge.

9. The cartridge according to claim 7, wherein the elongated deflector member has a surface area that faces the bottom of the cartridge which is less than the inner diameter of the annular bushing.

10. The cartridge according to claim 7, wherein the elongated deflector member is positioned centrally over the central hole formed in the bottom of the cartridge.

11. The cartridge according to claim 1, wherein the predetermined height of the deflector member over the bottom is one-tenth of a length of the cylindrical housing along the longitudinal axis.

* * * * *